US011459884B2

(12) United States Patent
Alruwaili et al.

(10) Patent No.: US 11,459,884 B2
(45) Date of Patent: Oct. 4, 2022

(54) MEASURING HORIZONTAL STRESS IN AN UNDERGROUND FORMATION

(71) Applicant: Saudi Arabian Oil Company, Dhahran (SA)

(72) Inventors: Khalid Mohammed M. Alruwaili, Dhahran (SA); Khaqan Khan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 538 days.

(21) Appl. No.: 16/548,351

(22) Filed: Aug. 22, 2019

(65) Prior Publication Data

US 2021/0054735 A1 Feb. 25, 2021

(51) Int. Cl.
*E21B 49/00* (2006.01)
*E21B 33/124* (2006.01)

(52) U.S. Cl.
CPC ..... *E21B 49/006* (2013.01); *E21B 33/124* (2013.01)

(58) Field of Classification Search
CPC ..... E21B 49/006; E21B 49/00; E21B 33/124
See application file for complete search history.

(56) References Cited

U.S. PATENT DOCUMENTS 3,712,379 A * 1/1973 Hill ..... E21B 43/26 166/308.1
5,111,881 A 5/1992 Soliman et al.
5,277,062 A 1/1994 Blauch et al.
5,517,854 A 5/1996 Plumb et al.
2008/0179060 A1 7/2008 Sugaatmadja et al.
2011/0017458 A1 1/2011 East et al.
2011/0067870 A1 3/2011 East
(Continued)

FOREIGN PATENT DOCUMENTS

WO WO 2010008684 1/2010
WO WO 2019064041 4/2019

OTHER PUBLICATIONS

PCT International Search Report and Written Opinion in International Appln. No. PCT/US2020/046968, dated Nov. 9, 2020, 15 pages.

(Continued)

*Primary Examiner* — Tarun Sinha
(74) *Attorney, Agent, or Firm* — Fish & Richardson P.C.

(57) ABSTRACT

Provided is a diagnostic wellbore testing method that includes forming a diagnostic wellbore in a subterranean zone including one or more formations. The wellbore extends through a portion of a formation having a maximum horizontal stress extending in a first direction and a minimum horizontal stress extending in a second direction perpendicular to the first direction. The method also includes forming a pair of notches on a circumference of the wellbore. The pair of notches are formed diametrically opposite each other. The method also includes applying fluidic pressure to the wellbore at the pair of notches in the second direction while avoiding applying fluidic pressure in the first direction. Fractures propagate from the pair of notches responsive to the fluidic pressure. The method also includes measuring a closure pressure of the wellbore, and providing the closure pressure as the maximum horizontal stress of the formation.

16 Claims, 5 Drawing Sheets

(56) References Cited

U.S. PATENT DOCUMENTS

| | | | | |
|---|---|---|---|---|
| 2011/0107830 | A1* | 5/2011 | Fields | E21B 49/008 73/152.41 |
| 2013/0199787 | A1 | 8/2013 | Dale et al. | |
| 2014/0078288 | A1 | 3/2014 | Wu | |
| 2018/0266183 | A1* | 9/2018 | Ayub | E21B 7/28 |
| 2019/0226956 | A1 | 7/2019 | Alruwaili et al. | |

OTHER PUBLICATIONS

GCC Examination Report in Gulf Cooperation Council Appln. No. GC 2020-40321, dated Oct. 18, 2021, 5 pages.

Aidagulov et al., "Model of Hydraulic Fracture Initiation from the Notched Open hole," SPE-178027-MS, presented at the SPE Saudi Arabia Section Annual Technical Symposium and Exhibition, Apr. 21-23, 2015, 13 pages.

Aidagulov et al., "Notching as a New Promising Well Intervention Technique to Control Hydraulic Fracturing in Horizontal Open Holes," AAPG Datapages/Search and Discovery Article #90254, presented at the 12th Middle East Geosciences Conference and Exhibition GEO-2016, Mar. 7-10, 2016.

* cited by examiner

MEASURING HORIZONTAL STRESS IN AN UNDERGROUND FORMATION

TECHNICAL FIELD

This disclosure relates to measuring properties of underground formations.

BACKGROUND OF THE DISCLOSURE

In hydraulic fracturing, well testing is used to enhance hydrocarbon production from wellbores. For some formations, it is important to establish the horizontal stresses of the formation prior to the main stimulation of the formation. Accurately determining the maximum horizontal stresses can save costs, prevent failure and avoid other underground problems.

SUMMARY

Implementations of the present disclosure include a diagnostic wellbore testing method. The method includes forming a diagnostic wellbore in a subterranean zone including one or more formations. The wellbore extends from a surface of the subterranean zone through a portion of a formation having a maximum horizontal stress extending in a first direction and a minimum horizontal stress extending in a second direction perpendicular to the first direction. The method also includes forming a pair of notches on a circumference of the wellbore. The pair of notches are formed diametrically opposite each other and extending away from the circumference of the wellbore in the second direction. The method also includes applying fluidic pressure to the wellbore at the pair of notches in the second direction while avoiding applying fluidic pressure in the first direction. Fractures propagate from the pair of notches responsive to the fluidic pressure. The method also includes measuring a closure pressure of the wellbore. The closure pressure is taken as the maximum horizontal stress of the formation at that particular depth.

In some implementations, forming the pair of notches includes lowering a notching tool into the wellbore after drilling or forming the wellbore and orienting the notching tool to form the pair of notches in the second direction. In some implementations, forming the pair of notches includes forming at least one of a pair of U-shaped notches, a pair of V-shaped notches, or a pair of O-shaped notches. In some implementations, forming the pair of notches includes jetting a fluid through the notching tool. In some implementations, orienting the notching tool includes rotating the notching tool about a longitudinal axis of the wellbore.

In some implementations, applying fluidic pressure to the wellbore at the pair of notches in the second direction while avoiding applying fluidic pressure in the first direction includes fluidically isolating the portion of the formation in the first direction from a remainder of the formation. In some implementations, fluidically isolating the portion of the formation in the first direction includes disposing a pair of packers adjacent the portion of the formation in the first direction, the pair of packers diverting the fluidic pressure away from the portion of the formation in the first direction.

In some implementations, measuring the closure pressure/stress includes sealing the wellbore and increasing the fluidic pressure in the sealed wellbore.

Implementations of the present disclosure also include a diagnostic wellbore testing method. The method includes forming a diagnostic wellbore in a subterranean zone including one or more formations. The wellbore extends from a surface of the subterranean zone through a portion of a formation having a maximum horizontal stress extending in a first direction and a minimum horizontal stress extending in a second direction perpendicular to the first direction. The method also includes forming a pair of notches on a circumference of the wellbore at a downhole location. The pair of notches are diametrically opposite each other and extend away from the circumference of the wellbore in the second direction. The method also includes sealing the first direction at the downhole location from fluidic pressure. The method also includes applying the fluidic pressure to the wellbore at the pair of notches in the second direction while the first direction is sealed from the fluidic pressure. The method also includes measuring a closure pressure of the wellbore, and providing the closure pressure as the maximum horizontal stress of the formation.

In some implementations, forming the pair of notches includes lowering a notching tool into the wellbore after forming the wellbore and orienting the notching tool to form the pair of notches in the second direction. In some implementations, forming the pair of notches includes forming at least one of a pair of U-shaped notches, a pair of V-shaped notches, or a pair of O-shaped notches. In some implementations, forming the pair of notches includes jetting a fluid through the notching tool. In some implementations, orienting the notching tool includes rotating the notching tool about a longitudinal axis of the wellbore.

In some implementations, sealing the first direction at the downhole location includes fluidically isolating the portion of the formation in the first direction from a remainder of the formation. In some implementations, fluidically isolating the portion of the formation in the first direction includes disposing a pair of packers adjacent the portion of the formation in the first direction, the pair of packers diverting the fluidic pressure away from the portion of the formation in the first direction In some implementations, measuring the closure pressure includes sealing the wellbore and increasing the fluidic pressure in the sealed wellbore.

Implementations of the present disclosure also includes a wellbore testing tool. The tool includes a jetting compartment fluidically coupled to a pipe configured to receive fluid from a surface of a wellbore. The jetting compartment is configured to be disposed within the wellbore at a subterranean zone including one or more formations. The wellbore extends through a portion of a formation having a maximum horizontal stress extending in a first direction and a minimum horizontal stress extending in a second direction perpendicular to the first direction. The jetting compartment includes two nozzles, each nozzle disposed in opposite sides of the jetting compartment. The nozzles are configured to jet fluid away from the jetting compartment to form a pair of notches on a circumference of the wellbore. The pair of notches are formed diametrically opposite each other and extend away from the circumference of the wellbore in the second direction. The tool also includes a first pair of mechanical packers configured to constrain fluid flow along a longitudinal axis of the wellbore. Each mechanical packer of the pair of mechanical packers is disposed at respective upstream and downstream ends of the jetting compartment. The upstream end is opposite the downstream end. The tool also includes a second pair of mechanical packers. Each mechanical packer of the second pair of mechanical packers is disposed at opposite sides of the jetting compartment between the nozzles. The second pair of mechanical packers are configured to prevent fluid from applying fluidic pressure along the first direction. The second pair of packers are configured to constrain the fluid to flow along the second direction such that applying fluidic pressure by the jetting compartment includes applying fluidic pressure at the notches to cause fractures to propagate from the pair of notches responsive to the fluidic pressure. The second pair of notches are configured to direct fluid such that a closure pressure of the wellbore can be provided as the maximum horizontal stress of the formation.

In some implementations, each mechanical packer of the second pair of mechanical packers includes a semicircular cross-sectional shape, each mechanical packer including a circumference that follows the circumference of the wellbore.

In some implementations, the tool further includes a general purpose inclinometry tool (GPIT) and a rotating motor communicatively coupled to the GIPT, the rotating motor and GPIT disposed upstream of the jetting compartment between the jetting compartment and the pipe, the motor configured to rotate the wellbore testing tool based on information received from the GPIT.

In some implementations, the nozzles are arranged to form at least one of a pair of U-shaped notches, a pair of V-shaped notches, or a pair of O-shaped notches.

DETAILED DESCRIPTION OF THE DISCLOSURE

The present disclosure relates to a method and apparatus for performing a modified Formation Fracture Test that allows a direct measurement of a maximum horizontal stress magnitude of a subterranean or subsurface formation. The method includes forming a pair of notches on opposite edges of a test or diagnostic wellbore that extends through the formation. The notches are formed in a direction perpendicular to the maximum horizontal stress of the formation. Then, mechanical packers are set to isolate desired sections of the formation. The test wellbore is pressurized, causing fractures to form and propagate from edges of the notches. The maximum horizontal stress is measured as a magnitude of closure pressure/stress. Conventional Formation Fracture Tests can be used to determine a minimum horizontal stress and then, based on the minimum horizontal stress, calculate the maximum horizontal stress of a formation as per prevailing stress equations while using wellbore failure indicators (for example, breakouts or drilling induced tensile cracks) as calibration. Other techniques used to attain indirect measurements of the in-situ minimum horizontal stresses include the step rate injectivity/flow back test, the shut-in/decline curve analysis, the inelastic strain recovery techniques, and the differential strain curve analysis.

Implementations of the present disclosure may provide one or more of the following advantages. Directly measuring the maximum horizontal stress magnitude of a formation during a modified Formation Fracture Test which can save time and resources, and provide more realistic measurements compared to the indirect methods. Constraining fluid flow only to notches of a wellbore during testing allows the maximum horizontal stress to be directly measured and increases the accuracy of readings by minimizing leak-offs. Measuring the maximum horizontal stress directly allows estimated values to be validated and thus improve the efficiency of downhole operations.

Figure 1:
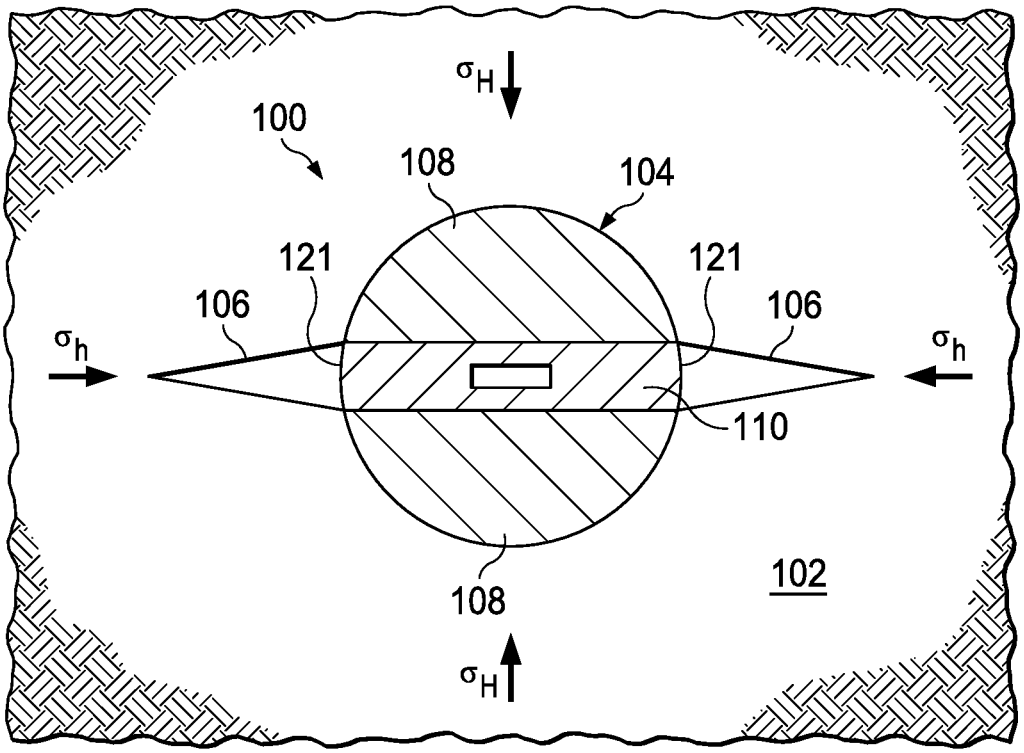
FIG. 1 illustrates a schematic top, cross-sectional view of a notching tool in a diagnostic wellbore.

FIG. 1 shows a notching and testing tool 100 inside a diagnostic wellbore 104 (for example, a vertical wellbore) to determine a maximum far-field horizontal stress '$\sigma_H$' of a formation 102. The notching tool 100 is a notching and testing tool, arranged to form notches in the wellbore 104 and to test the wellbore 104. Diagnostic wellbore 104 is formed in a subsurface zone or formation that has one or more formations 102 (for example, formations through which hydrocarbons flow). Diagnostic wellbore 104 extends from a ground surface through at least a portion of formation 102. Formation 102 has a maximum horizontal stress '$\sigma_H$' extending in a first direction and a minimum horizontal stress '$\sigma_h$' extending in a second direction perpendicular to the first direction. Notching tool 100 is connected to a tube or hose (shown in FIG. 3) that provides pressurized fluid (for example, water) to notching tool 100. Notching tool 100 directs the pressurized fluid toward a circumference of wellbore 104 to form, under fluidic pressure (for example, hydraulic pressure), a pair of notches 106 on the circumference of wellbore 104. Notching tool 100 forms notches 106 in a direction diametrically opposite to each other, extending away from the circumference of wellbore 104 in the second direction (in the direction of the minimum horizontal stress).

Figure 2:
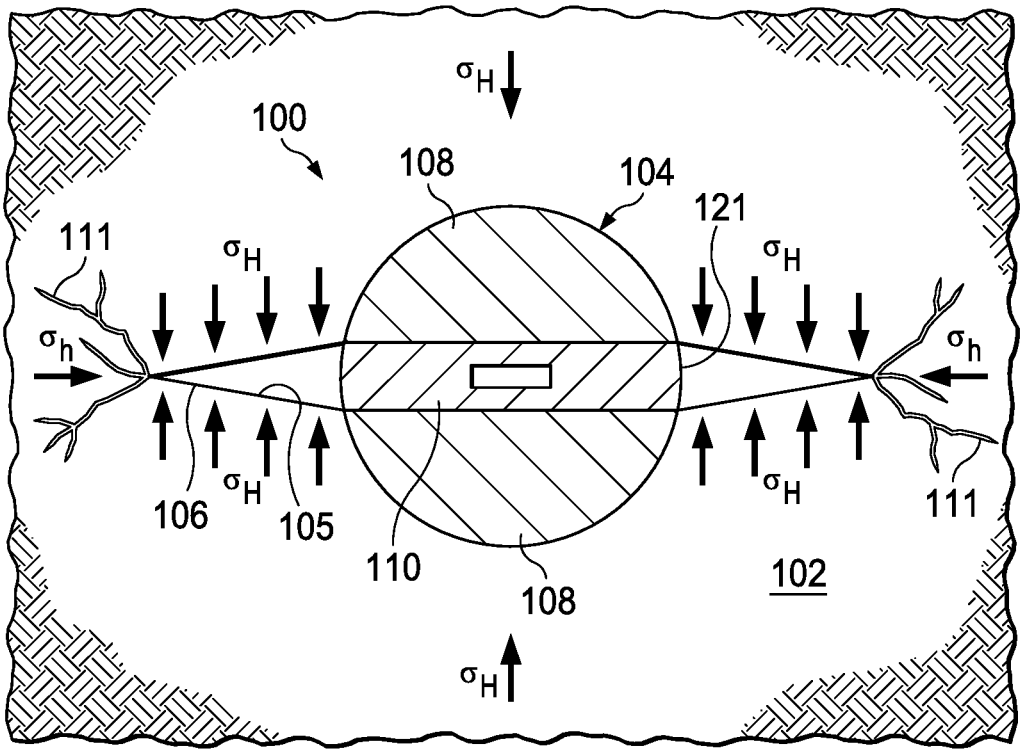
FIG. 2 illustrates a schematic top, cross-sectional view of the notching tool of FIG. 1, with pressurized fluid flowing into notches of the diagnostic wellbore.

Referring also to FIG. 2, after notches 106 have been formed, a modified Formation Fracture Test or procedure can be performed using notching tool 100 to directly measure the maximum horizontal stress '$\sigma_H$'. During a modified Formation Fracture Test, fluid is only flown in the direction of the minimum horizontal stress. Unlike conventional Formation Fracture Tests (not shown) that are performed by first sealing a volume of wellbore 104 (for example, sealing a portion of the formation) and then pressurizing an entire circumference of the wellbore with fluid, the modified Formation Fracture Test can pressurize only a portion of the wellbore to directly measure a maximum horizontal stress. Conventional Formation Fracture Tests can be used to directly measure the minimum horizontal stress.

In some implementations, in the modified Formation Fracture Test, notching tool 100 receives a second fluid 105 (for example, a viscous fluid) from the tube to apply fluidic pressure to wellbore 104 at the pair of notches 106 in the second direction. Notching tool 100 applies pressure at notches 106 while avoiding applying fluidic pressure in the first direction (in the direction of the maximum horizontal stress), such that fractures 111 propagate from the pair of notches 106 responsive to the fluidic pressure. A surface pressure gauge or downhole sensor at notching tool 100 or at the surface of wellbore 104 measures the closure pressure/stress of the wellbore. The closure pressure/stress of the wellbore 104 is the pressure exerted at the surface of wellbore 104 when wellbore 104 is closed or sealed (for example, when the zone is isolated by packers and the fluid is pumped from the surface until formation breakdown is observed). Measuring the closure pressure/stress includes measuring the increasing fluidic pressure in the isolated zone until reaching the formation breakdown. Then, the fluid pumping is stopped and the downhole pressure is continuously measured until stabilized to indicate the fracture closure pressure/stress. With notches 106 formed in the direction of the minimum horizontal stress, the closure pressure/stress is the stabilized pressure or the fracture closure pressure after fractures 111 form in formation 102. The fractures form when the rock of the formation is lifted. Lifting the rock of the formation may refer to widening or opening the fractures of the formation, which is critically required to create the so-called fractures in the zone so the maximum horizontal stresses can be measured. In such implementation, the closure pressure/stress is provided as the maximum horizontal stress '$\sigma_H$' of the formation. Thus, the maximum horizontal stress can be directly determined by using a modified Formation Fracture Test with notching tool 100. More specifically, and as further described in detail with respect to FIG. 8, when the viscous fluid enters notches 106 and pressurizes notches 106, notches 106 reach a point of failure in which fractures 111 or cracks start to form in the formation. Such point of failure is the peak strength of formation 102. As shown in FIG. 2, the magnitude of the closure pressure/stress, until failure, is the representation of the force loading in the opposite direction of the maximum horizontal far-field stress (represented with multiple arrows) at the notches 106. The maximum pressure induced until failure is the amount of force required to lift or open the rock mass in the direction of the maximum horizontal stress. Therefore, the closure pressure/stress (or the shut-in pressure) of the created fractures in the desired direction is a direct measurement of the maximum horizontal stress.

To form the notches 106 in the correct direction to perform the modified Formation Fracture Test described in this disclosure, first, the direction of the horizontal stresses in formation 102 have to be determined. The horizontal stresses can be determined from the drilling history of the field or from the breakout events in wellbores. After determining the direction of the horizontal stresses, notching tool 100 can be deployed downhole at the formation. As shown in FIGS. 1 and 2, notching tool 100 includes a pair of mechanical packers 108 each having a semicircular cross-sectional shape. Packers 108 are disposed on opposite sides of a jetting compartment 110 of notching tool 100. Packers 108 can have a circumference that follows the circumference of wellbore 104. Jetting compartment 110 has two exposed ends 121 with nozzles that direct fluid to notches 106. Knowing the direction of the horizontal stresses, notching tool 100 can be arranged in wellbore 104 such that packers 108 isolate the section of wellbore 104 along the maximum stress, and the nozzles face in the direction of the minimum horizontal stress.

Figure 3:
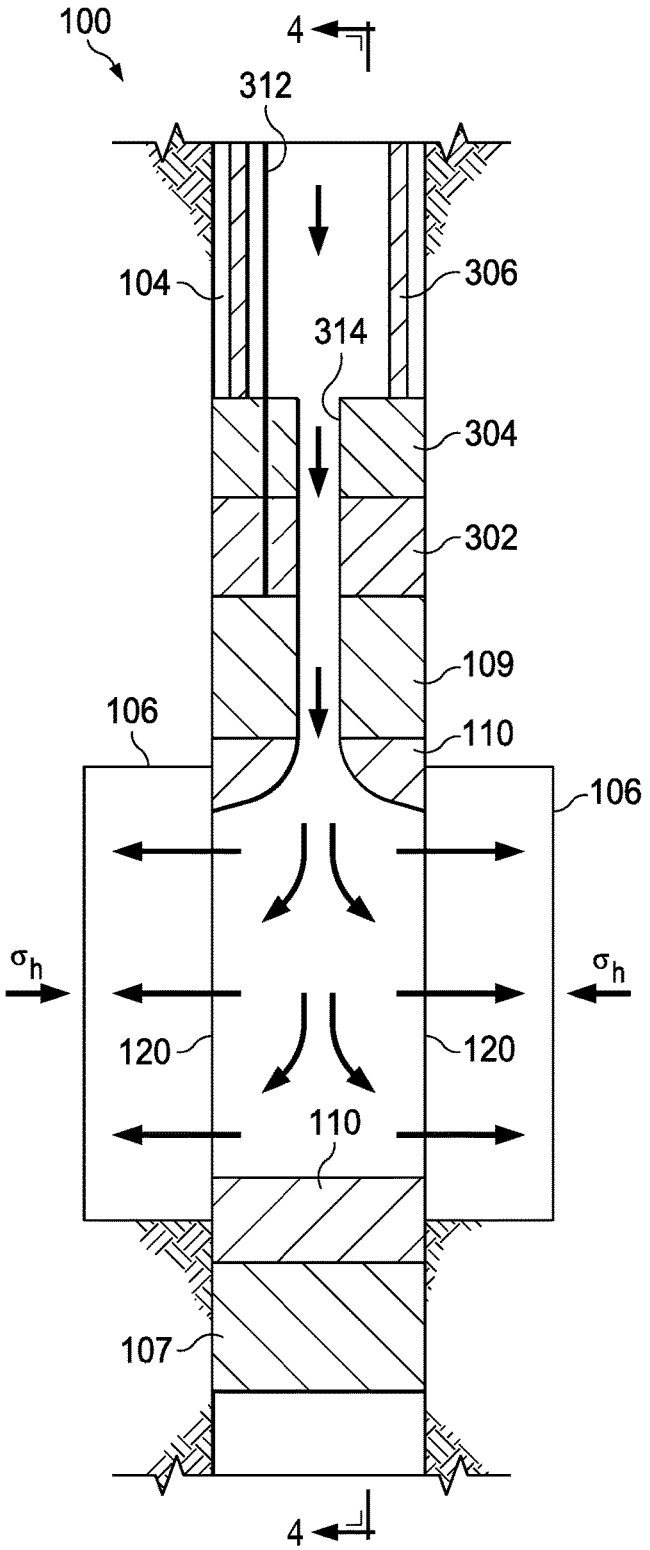
FIG. 3 illustrates a front, cross-sectional view of a notching tool in a diagnostic wellbore according to implementations of the present disclosure.
Figure 4:
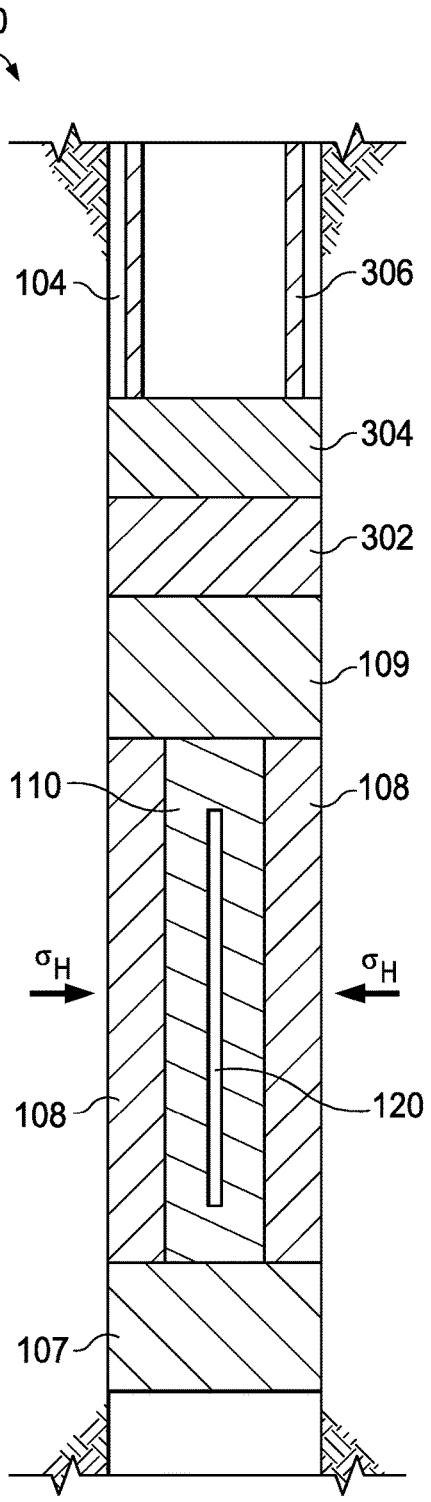
FIG. 4 shows the notching tool of FIG. 3 taken along line 4-4 in FIG. 3.

FIGS. 3 and 4 show front and side cross-sectional views (respectively) of notching tool 100 in diagnostic wellbore 104 according to implementations of the present disclosure. Notching tool 100 includes a general purpose inclinometry tool (GPIT) 304, a rotating motor 302, an upstream packer 109, a jetting compartment 110, a downstream packer 107, and side packers 108. Notching tool 100 can be lowered into wellbore 104 using wellbore tubing 312 (for example, a drilling pipe or coiled tubing). Jetting compartment 110 has nozzles 120 that converge toward the walls of wellbore 104. Nozzles 120 increase the velocity of fluid flowing through compartment 110 to jet fluid through tool 100 and penetrate the walls of wellbore 104. The fluid penetrates the walls to create notches 106 of a desired shape. The fluid flows from a surface of wellbore 104 through pipe 306 to notching tool 100. Each component upstream of jetting compartment 110 has or forms a channel 314 through which fluid from pipe 306 can flow to jetting compartment 110.

The GPIT component 304 can determine polar direction of north, south, east and west directions inside wellbore 104. GPIT component 304 can be used to determine the desired orientation of nozzles 120 to arrange notching tool 100 in the desired position. Motor 302 can rotate notching tool 100 about longitudinal axis of wellbore 104 to orientate the packers and notching tool. For example, GPIT component 304 can be communicatively or electrically connected to rotating motor 302 so that GPIT component 304 prompts, based on the orientation of nozzles 120, motor 302 to rotate the notching tool 100. Notching tool 100 is rotated such that nozzles 204 face in the direction of the minimum horizontal stress '$\sigma_h$'. Motor 302 can rotate the tool hydraulically or electrically. Motor 302 can rotate packers 109, 107, and 108, jetting compartment 110, and GPIT component 304. Each of the components of notching tool 100 can be mechanically coupled (for example, screwed on the top of each other).

Once notching tool 100 has been oriented, mechanical packers 109, 107, and 108 are set to isolate the desired section of wellbore 104. The packers can be hydraulically or electronically set. Upstream and downstream packers 109 and 107 prevent fluid from flowing in the longitudinal direction of wellbore 104. As shown in FIG. 4, side packers 108 prevent fluid from applying fluidic pressure in the direction of the maximum horizontal pressure '$\sigma_H$'. Thus, the packers can form a volume around jetting compartment 110 that prevents fluid from flowing in a longitudinal direction away from jetting compartment 110 and in one horizontal or radial direction of the wellbore. Side packers 108 can fluidically isolate the portion of the formation in the maximum horizontal pressure direction from the remainder of the formation. Specifically, side packer 108 can be disposed adjacent the portion of the formation in the maximum horizontal pressure direction to divert the fluidic pressure away from the portion of the formation in the maximum horizontal stress direction. Packers are placed in the wellbore 104 to cover the regions of the wellbore that may fail in tensile mode. Without side packers 108, the fluid could enter the pores of the formation during pumping of fluid which alters the pressure in the weak regions. The pore pressure is increased, causing the effective and principal stress to decrease, which affects the desired fracture direction. With side packers 108, the principal or effective stresses do not change dues to the side-wall packers in the borehole. Thus, the main purpose of the side packers 108 is to prevent fracturing in an unwanted zone so the maximum horizontal stresses can be accurately measured.

The placement of the packers also minimize the "leak-off" in the zone of wellbore 104 where the tangential stresses are maximum. Leak-off can be minimized in the region where the rock has already dilated so that effective stress remains stable within the region. For example, after the wellbore 104 is formed, the far-field loading (horizontal stresses) acts on the wellbore circumference leading to the creation of weak zones in the region opposite to the maximum horizontal stress. Without the packers, when the second fluid is pumped into the section of the wellbore, the fluid permeate into the porous media and cause more dilation into the already weak zones. Thus, without packers, the fractures will most likely be created in the undesired direction. Using the packers to isolate these sections are critical to the success of the test by minimizing fluid invasion into these dilated regions.

As shown in FIG. 3, upon setting the mechanical packers 109, 107, and 108, notches 106 can be formed by jetting fluid through nozzles 120. The dimensions of notches 106 should be optimum to aid in the propagation of fractures and to provide accurate readings to determine the maximum horizontal stress. The optimum dimensions of the notch is a function of the geo-mechanical properties and in situ stress contrasts of the underground formation. Simulation run to prove that the fracture will propagate in the desired direction can be used. To determine the required dimension of notches 106, rigorous numerical modeling (for example, computer modeling) and simulations can be used. Generally, notches 106 should have a length that is enough to bypass the region of the high hoop or tangential stresses (for example, a length 2-3 times the diameter of the wellbore). Notch 106 can have a height of about 5 to 10 inches. For example, to determine the dimensions of the notches 106, a two-dimensional numerical model can be discretized with triangle or quadrat mesh. The two-dimensional geometry is constructed with a pre-existing borehole and notch shapes. The mesh is refined around the borehole and the notches geometries to increase the accuracy of the numerical calculation. The fluid and rock mechanical properties are defined and populated throughout the two-dimensional model. The two-dimensional model is re-constructed with different notch shapes and dimension and the fluid pumping is simulated until fractures are created in the desire direction. The final dimension of the notches are considered optimum for the field application. Simulation for sensitivity analysis can be used to determine the magnitude of fluidic pressure required to create notch 106. Thus, the shape of the notch 106 can be pre-designed and engineered with specific dimensions and shape prior to fracturing. The design allows controlled propagation of the fractures.

Figure 5:
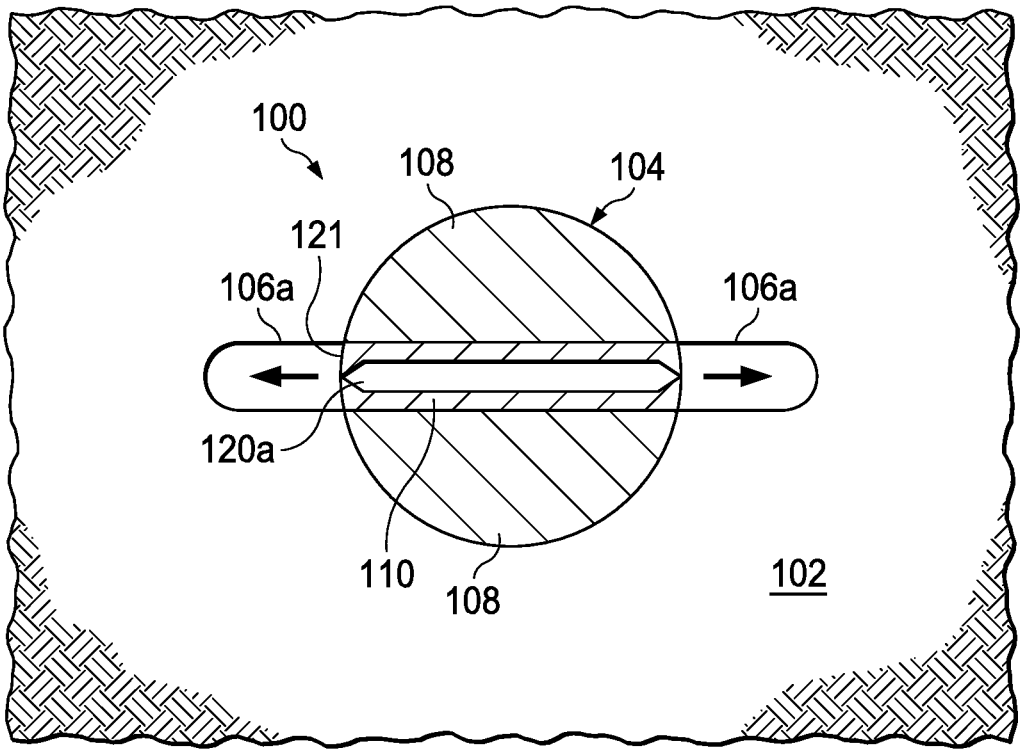
FIGS. 5-7 illustrate schematic top, cross-sectional views of different nozzles of the notching tool.
Figure 6:
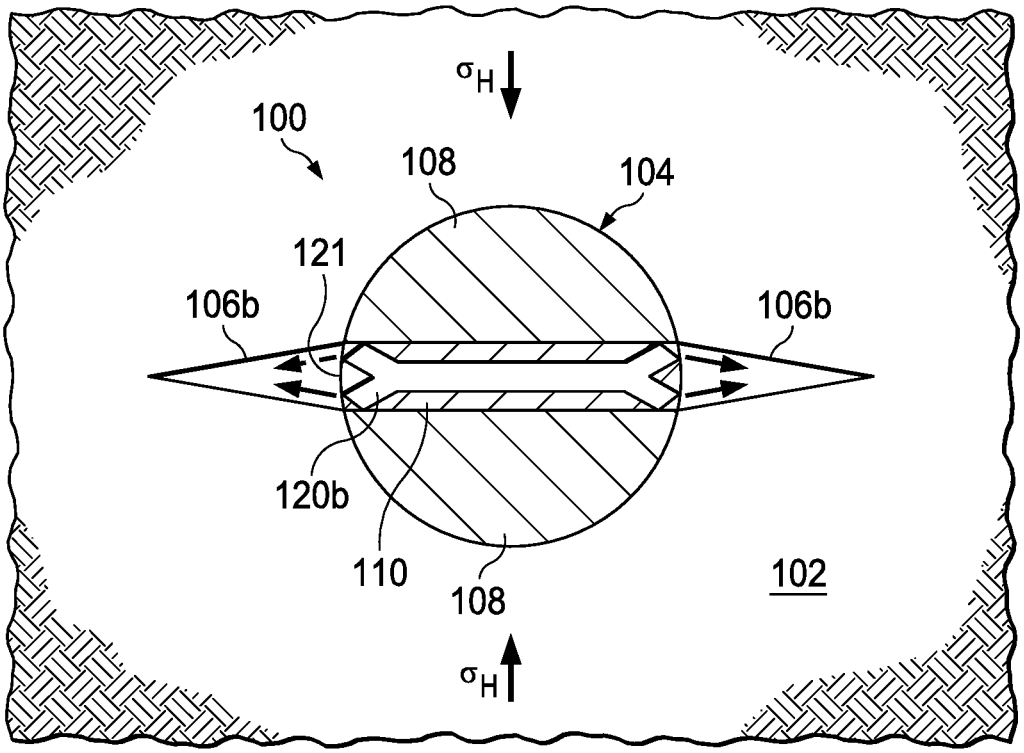
Figure 7:
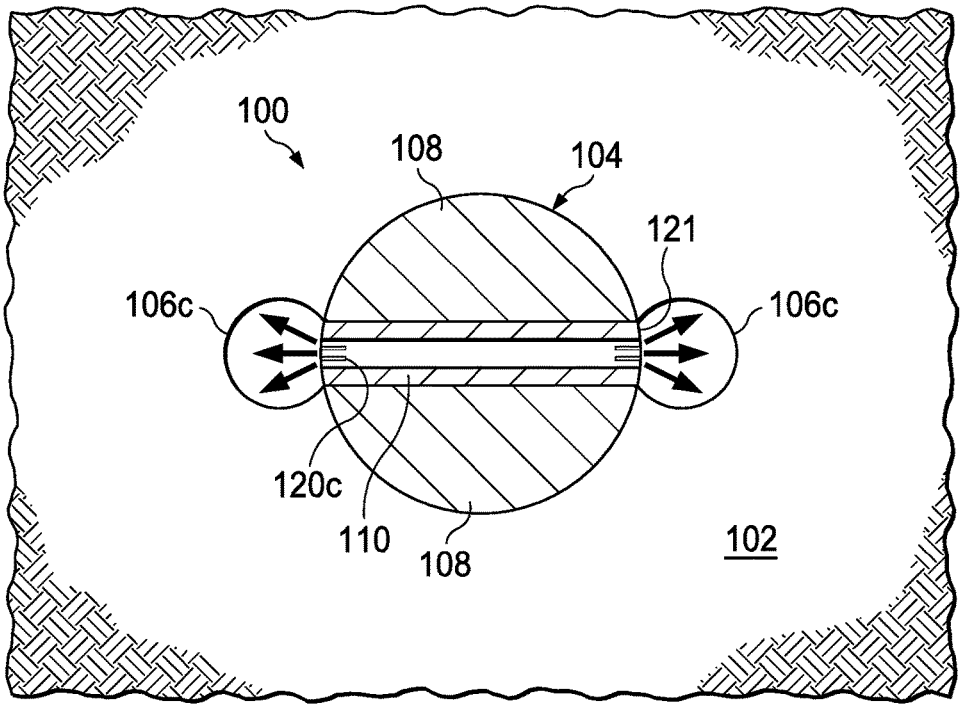

Referring to FIGS. 5-7, notching tool 100 can have multiple types of nozzles to form multiple shapes of notches 106. For example, referring to FIG. 5, notching tool 100 has a central nozzle 120*a* on each end 121 of compartment 110 that jet fluid in an orthogonal direction with respect the ends 121 of compartment 110. Central nozzles 120*a* jet fluid to form a U-shaped notch 106*a*. Referring to FIG. 6, notching tool 100 has two spaced-apart nozzles 120*b* on each end 121 of compartment 110 that jet fluid in a non-orthogonal direction to form a triangular stream of fluid. The spaced-apart nozzles 120*b* jet fluid to form a V-shaped notch 106*b*. Referring to FIG. 7, notching tool 100 has three or more nozzles 120*c* on each end 121 of compartment 110 that jet fluid in different directions away from each other. The three or more nozzles 120*c* jet fluid to form an O-shaped notch 106*c*. In some implementations, the same jetting compartment 110 can have all the nozzles shown in FIGS. 5-7, and some nozzles can be selectively blocked (or used) to form the desired configurations of nozzles. Thus, the same tool 100 has the capability to make notches of different shapes.

Figure 8:
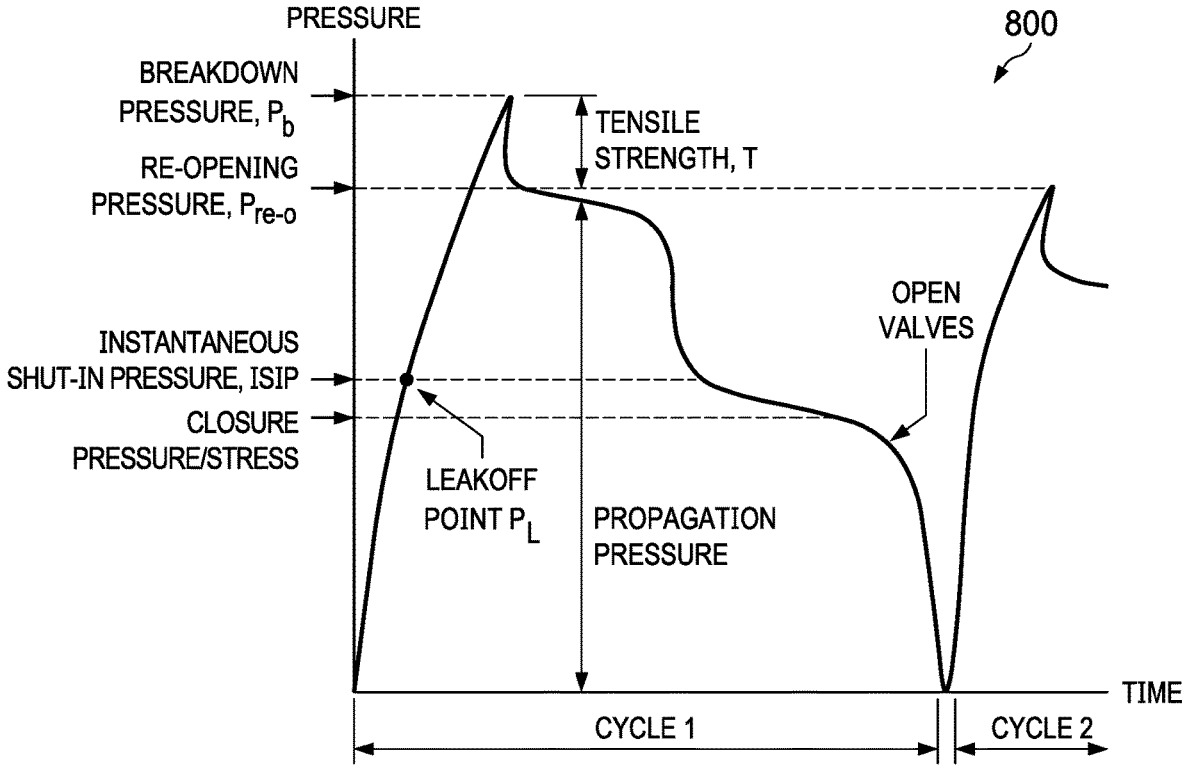
FIG. 8 is a pressure vs time curve showing the change in pressure during a modified Formation Fracture Test according to implementations of the present disclosure.

Referring now to FIGS. 2 and 8, after notches 106 have been formed, a Formation Fracture Test can be done to directly determine the maximum horizontal stress. The modified Formation Fracture Test is done by pumping viscus fluid 105 into jetting compartment 110 to flow into notches 106 and measuring the closure pressure/stress and the instantaneous shut-in pressure of wellbore 104. Fluid can be flown from both the annulus (for example, the space between the outer diameter of the production/injection pipe and the inner diameter of the borehole) and nozzles 120 to create a mini fracture 111 in the notch 106 (for example, in a corner of a V-shaped notch). Surface pressure measurements are monitored to measure the closure pressure and the instantaneous shut-in pressure. The fluid 105 is pumped for a period of time making sure fractures 111 initiated at the notches extend into the formation at least 2-3 times the radius of the wellbore 104 beyond the wellbore wall. After that, pumping is stopped and sufficient time is allowed for the pressure dissipation and the fracture 111 to close.

Referring to FIG. 8, the pressure-time curve 800 represents the change in pressure as fluid is pumped into the portion of the formation with the notching tool. The pressure at the wellbore first increases generally constant to a leak off point or a leak off pressure '$P_L$' when pressure starts leaking off because of fractures. The slope of the pressure curve changes at the leak off point and keeps increasing to a breakdown pressure '$P_b$'. At the breakdown pressure, the fractures start propagating faster than the fluid is being pumped. The pressure of the wellbore then reaches a generally constant pressure at the re-opening pressure '$P_{re\text{-}o}$', when the fractures open generally as fast as fluid is being pumped. After pressure remains generally constant for a period of time, fluid stops pumping into the wellbore and the wellbore is temporarily sealed or closed to measure the closure pressure/stress and instantaneous shut-in pressure (ISIP). Such point of failure is the peak strength of the formation. Because the notches extend in the direction of the minimum horizontal stress, the maximum pressure induced until rock failure is the amount of force required to lift or open the rock mass in the direction of the maximum horizontal stress (in a direction perpendicular to the minimum horizontal stress). Therefore, the closure pressure/stress is a direct measurement of the maximum horizontal stress.

Figure 9:
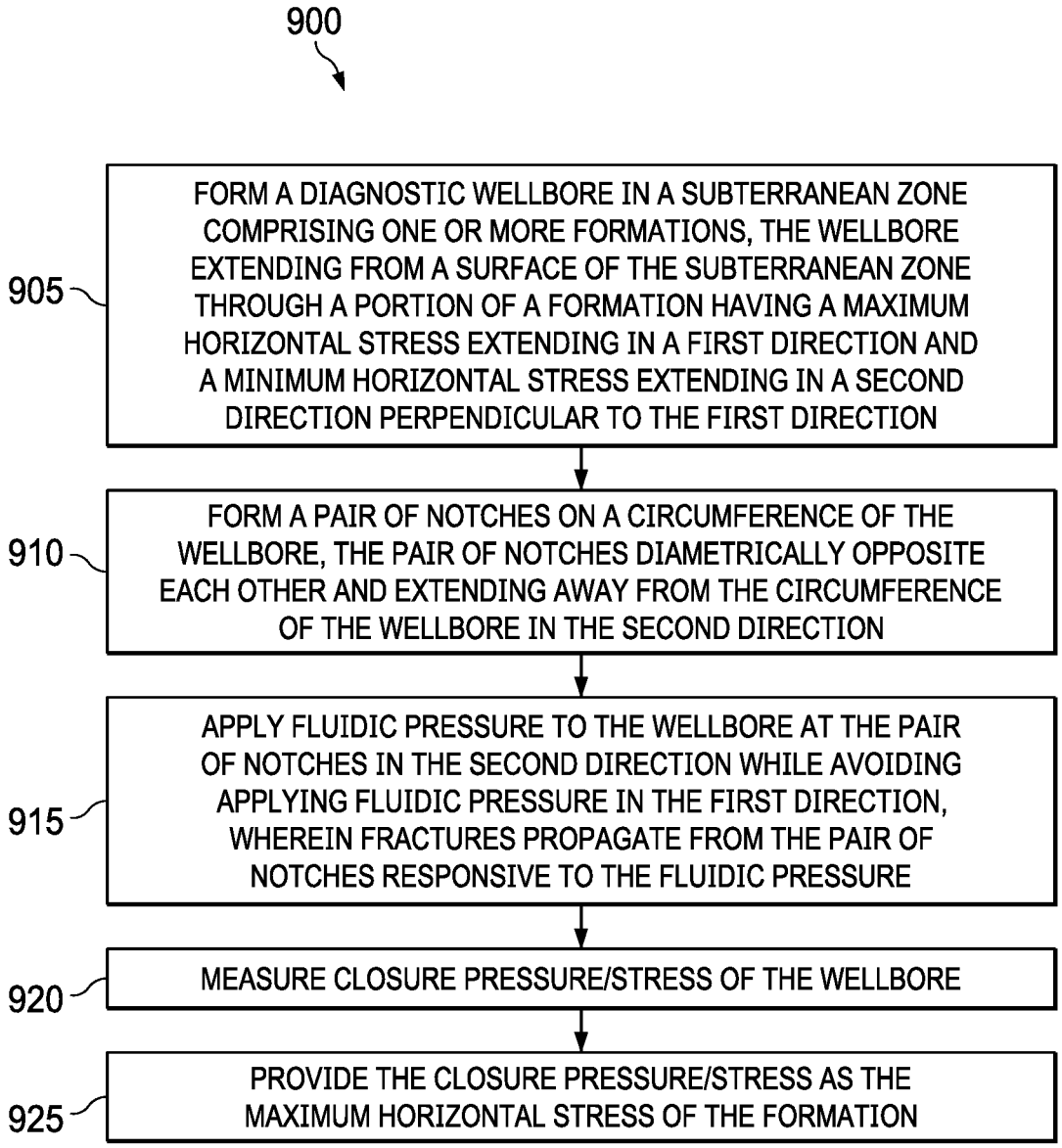
FIG. 9 is a flow chart of an example method of determining the maximum horizontal stress of a formation.

Referring to FIG. 9, a diagnostic wellbore testing method (900) includes forming a diagnostic wellbore in a subterranean zone including one or more formations. The wellbore extends from a surface of the subterranean zone through a portion of a formation that has a maximum horizontal stress extending in a first direction and a minimum horizontal stress extending in a second direction perpendicular to the first direction (905). The method also includes forming a pair of notches on a circumference of the wellbore, the pair of notches diametrically opposite each other and extending away from the circumference of the wellbore in the second direction (910). The method also includes applying fluidic pressure to the wellbore at the pair of notches in the second direction while avoiding applying fluidic pressure in the first direction, where fractures propagate from the pair of notches responsive to the fluidic pressure (915). The method also includes measuring the closure pressure (920), and providing the closure pressure as the maximum horizontal stress of the formation (925).

Although the present detailed description contains many specific details for purposes of illustration, it is understood that one of ordinary skill in the art will appreciate that many examples, variations and alterations to the following details are within the scope and spirit of the disclosure. Accordingly, the example implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

Ranges may be expressed in the present disclosure as from about one particular value, or to about another particular value or a combination of them. When such a range is expressed, it is to be understood that another implementation is from the one particular value or to the other particular value, along with all combinations within said range or a combination of them.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

That which is claimed is:

1. A diagnostic wellbore testing method comprising:

forming a diagnostic wellbore in a subterranean zone comprising one or more formations, the wellbore extending from a surface of the subterranean zone through a portion of a formation having a maximum horizontal stress extending in a first direction and a minimum horizontal stress extending in a second direction perpendicular to the first direction;

forming a pair of notches on a circumference of the wellbore, the pair of notches diametrically opposite each other and extending away from the circumference of the wellbore in the second direction;

applying fluidic pressure to the wellbore at the pair of notches in the second direction while avoiding applying fluidic pressure in the first direction by fluidically isolating the portion of the formation in the first direction from a remainder of the formation, and fluidically isolating the portion of the formation in the first direction comprises disposing one or more packers adjacent the portion of the formation in the first direction, the one or more packers diverting the fluidic pressure away from the portion of the formation in the first direction, wherein fractures propagate from the pair of notches responsive to the fluidic pressure;

measuring a closure pressure of the wellbore; and providing the closure pressure as the maximum horizontal stress of the formation.

2. The method of claim 1, wherein forming the pair of notches comprises lowering a notching tool into the wellbore after forming the wellbore and orienting the notching tool to form the pair of notches in the second direction.

3. The method of claim 2, wherein forming the pair of notches comprises forming at least one of a pair of U-shaped notches, a pair of V-shaped notches, or a pair of O-shaped notches.

4. The method of claim 2, wherein forming the pair of notches comprises jetting a fluid through the notching tool.

5. The method of claim 2, wherein orienting the notching tool comprises rotating the notching tool about a longitudinal axis of the wellbore.

6. The method of claim 1, wherein measuring the closure pressure comprises sealing the wellbore and increasing the fluidic pressure in the sealed wellbore.

7. A diagnostic wellbore testing method comprising:

forming a diagnostic wellbore in a subterranean zone comprising one or more formations, the wellbore extending from a surface of the subterranean zone through a portion of a formation having a maximum horizontal stress extending in a first direction and a minimum horizontal stress extending in a second direction perpendicular to the first direction;

forming a pair of notches on a circumference of the wellbore at a downhole location, the pair of notches diametrically opposite each other and extending away from the circumference of the wellbore in the second direction;

sealing the first direction at the downhole location from fluidic pressure;

applying the fluidic pressure to the wellbore at the pair of notches in the second direction while the first direction is sealed from the fluidic pressure by fluidically isolating the portion of the formation in the first direction from a remainder of the formation, and fluidically isolating the portion of the formation in the first direction comprises disposing one or more packers adjacent the portion of the formation in the first direction, the one or more packers diverting the fluidic pressure away from the portion of the formation in the first direction;

measuring a closure pressure of the wellbore; and providing the closure pressure as the maximum horizontal stress of the formation.

8. The method of claim 7, wherein forming the pair of notches comprises lowering a notching tool into the wellbore after forming the wellbore and orienting the notching tool to form the pair of notches in the second direction.

9. The method of claim 8, wherein forming the pair of notches comprises forming at least one of a pair of U-shaped notches, a pair of V-shaped notches, or a pair of O-shaped notches.

10. The method of claim 8, wherein forming the pair of notches comprises jetting a fluid through the notching tool.

11. The method of claim 8, wherein orienting the notching tool comprises rotating the notching tool about a longitudinal axis of the wellbore.

12. The method of claim 7, wherein measuring the closure pressure comprises sealing the wellbore and increasing the fluidic pressure in the sealed wellbore.

13. A wellbore testing tool comprising:

a jetting compartment fluidically coupled to a pipe configured to receive fluid from a surface of a wellbore, the jetting compartment configured to be disposed within the wellbore at a subterranean zone comprising one or more formations, the wellbore extending through a portion of a formation having a maximum horizontal stress extending in a first direction and a minimum horizontal stress extending in a second direction perpendicular to the first direction, the jetting compartment comprising two nozzles, each nozzle disposed in opposite sides of the jetting compartment, the nozzles configured to jet fluid away from the jetting compartment to form a pair of notches on a circumference of the wellbore, the pair of notches diametrically opposite each other and extending away from the circumference of the wellbore in the second direction;

a first pair of mechanical packers configured to constrain fluid flow along a longitudinal axis of the wellbore, each mechanical packer of the pair of mechanical packers disposed at respective upstream and downstream ends of the jetting compartment, the upstream end opposite the downstream end; and a second pair of mechanical packers, each mechanical packer of the second pair of mechanical packers disposed at opposite sides of the jetting compartment between the nozzles, the second pair of mechanical packers configured to prevent fluid from applying fluidic pressure along the first direction, the second pair of packers configured to constrain fluid flow along the second direction such that applying fluidic pressure by the jetting compartment comprises applying fluidic pressure at the notches to cause fractures to propagate from the pair of notches responsive to the fluidic pressure, and such that a closure pressure of the wellbore can be provided as the maximum horizontal stress of the formation.

14. The wellbore testing tool of claim 13, wherein each mechanical packer of the second pair of mechanical packers comprises a semicircular cross-sectional shape, each mechanical packer comprising a circumference that follows the circumference of wellbore 104.

15. The wellbore testing tool of claim 13, further comprising a general purpose inclinometry tool (GPIT) and a rotating motor communicatively coupled to the GIPT, the rotating motor and GPIT disposed upstream of the jetting compartment between the jetting compartment and the pipe, the motor configured to rotate the wellbore testing tool based on information received from the GPIT.

16. The wellbore testing tool of claim 13, wherein the nozzles are arranged to form at least one of a pair of U-shaped notches, a pair of V-shaped notches, or a pair of O-shaped notches.

* * * * *